US006406740B1

(12) United States Patent
Komuro

(10) Patent No.: US 6,406,740 B1
(45) **Date of Patent: *Jun. 18, 2002**

(54) METHOD OF MANUFACTURING A LIQUID JET RECORDING APPARATUS AND SUCH A LIQUID JET RECORDING APPARATUS

(75) Inventor: Hirokazu Komuro, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/555,064

(22) Filed: Nov. 8, 1995

Related U.S. Application Data

(62) Division of application No. 08/406,799, filed on Mar. 20, 1995, now abandoned, which is a continuation of application No. 08/077,872, filed on Jun. 18, 1993, now abandoned.

(30) Foreign Application Priority Data

| | | |
|---|---|---|
| Jun. 23, 1992 | (JP) | 4-165012 |
| Jun. 23, 1992 | (JP) | 4-165013 |
| Jun. 23, 1992 | (JP) | 4-165014 |
| Jun. 23, 1992 | (JP) | 4-165015 |
| Jun. 23, 1992 | (JP) | 4-165016 |
| Jun. 23, 1992 | (JP) | 4-165017 |
| Jun. 23, 1992 | (JP) | 4-165018 |
| Jun. 23, 1992 | (JP) | 4-165019 |

(51) Int. Cl.[7] ..... B05D 5/12

(52) U.S. Cl. ..... 427/58; 427/241; 427/101; 29/610.1

(58) Field of Search ..... 29/610.1; 427/58, 427/127, 131, 79, 101, 103, 240, 241; 346/140 R, 140.1; 156/643

(56) References Cited

U.S. PATENT DOCUMENTS

| | | | |
|---|---|---|---|
| 3,568,127 A | 3/1971 | Aimi | 338/262 |
| 3,629,781 A | 12/1971 | Helgelang | 338/276 |
| 4,313,124 A | 1/1982 | Hara | 346/140 |
| 4,345,262 A | 8/1982 | Shirato et al. | 346/140 |

(List continued on next page.)

FOREIGN PATENT DOCUMENTS

| | | | |
|---|---|---|---|
| EP | 477378 | * | 4/1992 |
| JP | 54-051837 | | 4/1979 |
| JP | 54-056847 | | 5/1979 |
| JP | 14559 | * | 1/1983 |
| JP | 59-123670 | | 7/1984 |
| JP | 60-071260 | | 4/1985 |
| JP | 1-202457 | | 8/1989 |
| JP | 59-138461 | | 8/1994 |

*Primary Examiner*—Brian K. Talbot
(74) *Attorney, Agent, or Firm*—Fitzpatrick, Cella, Harper & Scinto

(57) ABSTRACT

Disclosed is a method of manufacturing a liquid jet recording head by which a thin film composed of an inorganic material can be formed by a conventionally used method such as a printing method and coating method executed in the atmosphere, the method being able to be relatively easily achieved, a head made by the manufacturing method, and a liquid jet recording apparatus including the head and a member for mounting the head. According to this invention, there is provided a liquid jet recording apparatus including a heat acting portion communicating with a liquid jetting orifice for applying thermal energy to a liquid to form a bubble, an electrothermal converter for generating the thermal energy, a heat generating resistance layer contained in the electrothermal converter, and electrode layers for imposing a voltage to the heat generating resistance layer contained in the electrothermal converter, wherein the heat generating resistance layer is composed mainly of an organic resinate.

4 Claims, 3 Drawing Sheets

U.S. PATENT DOCUMENTS 4,450,457 A * 5/1984 Miyachi et al. ..... 346/140 R
4,459,600 A 7/1984 Sato et al. ..... 346/140
4,459,603 A 7/1984 Kimoto ..... 346/155
4,463,359 A 7/1984 Ayata et al. ..... 346/1.1
4,663,640 A 5/1987 Ikeda
4,719,478 A 1/1988 Tachihara et al. ..... 346/140
4,720,716 A 1/1988 Ikeda et al. ..... 346/140
4,723,129 A 2/1988 Endo et al. ..... 346/1.1
4,737,803 A 4/1988 Fujimura et al.
4,740,796 A 4/1988 Endo et al. ..... 346/1.1
4,889,587 A 12/1989 Komuro ..... 156/643
4,922,269 A 5/1990 Ikeda et al.
4,965,594 A * 10/1990 Komuro ..... 346/140 R
5,041,847 A 8/1991 Matsumoto et al.
5,122,777 A 6/1992 Shiratsuki et al. ..... 338/306
5,142,308 A * 8/1992 Haegawa et al. ..... 346/140 R
5,211,754 A 5/1993 Komuro ..... 118/300
5,468,679 A * 11/1995 Paz de Araujo et al. .... 437/110

* cited by examiner

METHOD OF MANUFACTURING A LIQUID JET RECORDING APPARATUS AND SUCH A LIQUID JET RECORDING APPARATUS

This application is a division of application Ser. No. 08/406,799 filed Mar. 20, 1995, now abandoned, which was a continuation of application Ser. No. 08/077,872, filed on Jun. 18, 1993, and now abandoned.

BACKGROUND OF THE INVENTION

1. Field of the Invention

The present invention relates to a liquid jet recording head for jetting liquid from an orifice and forming droplets and a method of manufacturing the same.

2. Related Background Art

Conventionally, there is known a liquid jet recording method (ink jet recording method) for jetting liquid from an orifice and executing recording by a droplet thereof. For example, Japanese Laid-Open Patent Application No. 54-51837 discloses a type of a liquid jet recording method by which power for jetting droplets is obtained by applying thermal energy to liquid. This kind of the recording method is characterized in that liquid to which the action of thermal energy is applied is heated to produce bubbles, droplets are formed from the orifice at the extreme end of a recording head by an acting force due to the production of the bubbles, and the droplets are deposited on a recording member for recording information.

The liquid jet portion of a recording head applied to this recording method includes an orifice for jetting liquid and a liquid flow path communicating with the orifice. A portion of the liquid flow path is composed as a heat acting portion where thermal energy for jetting droplets is acted to the liquid. Further, the recording head includes a heat generating resistance layer as a thermal converter serving as a thermal energy generating means and an upper protection layer for protecting the heat generating resistance layer from ink.

In order to effectively bubble ink in this type of the recording method, a bubbling surface must be heated to about 300° C. at very short pulse intervals and the temperature thereof must be returned to a room temperature in an order of microsecond. For this purpose, the heat generating resistance layer itself must have a reduced thermal capacity. Further, a thermal resistance between the heat generating resistance layer and the bubbling surface (more specifically, the thermal resistance of electrodes and the upper protection layer) must be also reduced because of the same reason. On the other hand, since the heat generating resistance layer, electrodes and upper protection layer are usually formed by lamination, if the heat generating resistance layer and electrodes have an excessively thin width, the step of these portions is relatively increased. When the stepped portion is increased, the quality of the film of the upper protection layer covering these portions is deteriorated and thus a problem of the electric erosion and the like of the electrodes and heat generating resistance layer arises.

Therefore, it is preferable to make a film thickness thin as a means for reducing the thermal capacity of the heat generating resistance layer. Further, a thermal resistance can be reduced by making the film thickness of the electrodes and upper protection layer. A specific film thickness is preferably 0.1 to 1 micron. Conventionally, when an inorganic material used for the heat generating resistance layer, electrodes and protection layer is formed to such a film thickness, the film is formed by using a vacuum process such as a vacuum vapor deposition and sputtering method. The vacuum process, however, needs a large manufacturing apparatus as well as the productivity thereof is not so good because severe environmental conditions are required for the formation of a good thin film. Further, this process is not always preferable from the view point of cost because the manufacturing apparatus is expensive.

SUMMARY OF THE INVENTION

Taking the above problem into consideration, the inventor has discovered a completely novel method as a result of a zealous study. The present invention provides a method of manufacturing a liquid jet recording head by which a thin film composed of an inorganic material can be formed by a conventionally use a method such as a printing method and coating method executed in the atmosphere, the method being able to be relatively easily achieved, a head made by the manufacturing method, and a liquid jet recording apparatus including the head and a member for mounting the head. A main object of the present invention is to provide a liquid jet recording apparatus including a heat acting portion communicating with a liquid jetting orifice for applying thermal energy to a liquid to form a bubble, an electrothermal converter for generating the thermal energy, a heat generating resistance layer contained in the electrothermal converter, and electrode layers for imposing a voltage to the heat generating resistance layer contained in the electrothermal converter, wherein the heat generating resistance layer is composed mainly of an organic resinate.

The organic resinate used in the present invention generally includes carboxylate, carboxylic acid ester, arkoxide, rosin ester, polycyclic organic compound, siloxanes, bolic acid compound, and the like.

According to the present invention, since a desired thin film can be easily formed in the atmosphere, a highly reliable liquid jet recording head of low cost with high productivity can be provided. Further, the liquid jet recording head can stably jet liquid even if it is driven at a high frequency because a thick film such as that formed of a dispersed material of inorganic material and glass used in a conventional printing method and coating method is not formed and the surface property of a film is not degraded.

Further, the inventors have discovered that the present invention has an advantage completely different from the aforesaid advantage in addition to it. That is, according to the present invention, defective portions such as pin holes and the like of a thin film conventionally found in a sputtering method and the like are greatly reduced. This is supposed to be caused by the fact that the thin film is not liable to be porous because it is not affected by a high voltage imposed thereon and severe environmental conditions. This advantage can further reduce the electric erosion of a heat generating resistance layer and electrode by ink.

As described above, the present invention is epoch-making in that when a thin film is formed of an inorganic material, the film is made as fine as a film composed of an organic material and the film can be formed easily.

DETAILED DESCRIPTION OF THE PREFERRED EMBODIMENT

Figure 1:
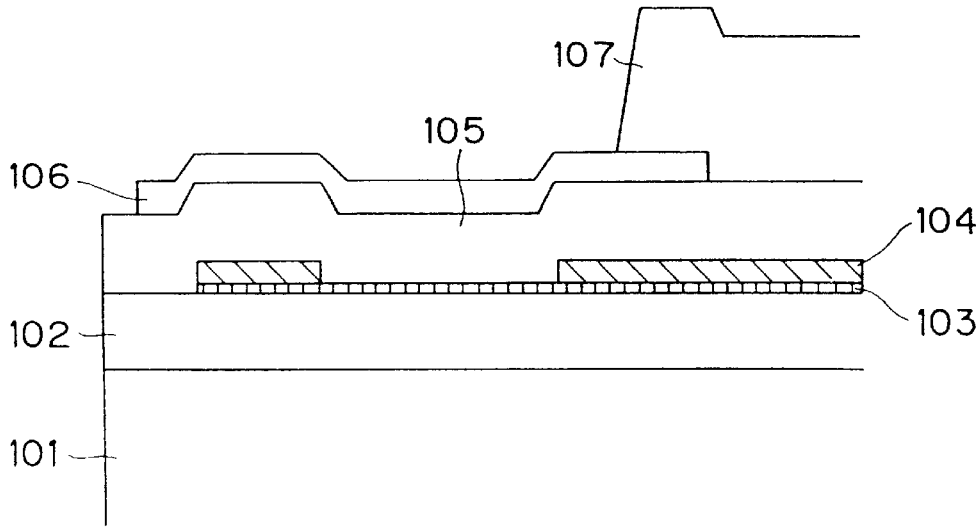
FIG. 1 is a schematic partial cross sectional view showing the layer arrangement of the heater board of a recording head made to Examples 1–23.

The present invention will be described below in more detail.

Although a property required to a heat generating resistance layer is a small thermal capacity as described above, this property relates to the bubbling stability of bubbles, and in particular an increase in a driving frequency increases the effect of the bubbling stability, which leads to unstable bubbling and jet operation in its turn. Further, as a recent tendency, as a recording head has an increased length and an apparatus has a reduced size, a heat generating portion is required to save power consumption, and thus the resistance of the heat generating resistance layer is increased.

A material satisfying these properties includes $ZrB_2$, $TiB_2$, $Ta_2Si$, $Ti_2Si$, TaAl and the like. The present invention forms the heat generating resistance layer composed mainly of an organic resinate containing these inorganic materials so that a thin film having substantially the same property as that of a thin film formed by a vacuum process such as a conventional sputtering method and the like can be formed. Further, since the thin film can be formed in the atmosphere, a recording head which is more reliable and more durable than a conventional recording head can be made.

Although a metal such as Au, Al having a high conductivity has been used as electrodes, the present invention can form a thin film having substantially the same property as that of a thin film conventionally formed by the vacuum process such as the sputtering method and the like by forming the electrodes mainly of an organic resinate containing these metals.

Further, in the case of a liquid jet recording head of a type in which the heat generating resistance layer and electrodes come into direct contact with ink, a material excellent in electrochemical stability must be used in addition to the aforesaid respective characteristics. For example, a material such as WNi, ZrCr, TaIr, TaFe, ZrNi is used as the heat generating resistance layer, and a material such as Au, Pt is used as the electrodes. The present invention can provide a highly reliable liquid jet recording apparatus by forming the heat generating resistance layer and electrodes formed mainly of an organic resinate containing these respective materials.

Moreover, since the thin film formed by the present invention includes a reduced number of defective portions such as pin holes, a resistance value is not partially concentrated, and thus the reliability of the heat generating resistance layer and electrodes can be greatly improved.

Although the present invention can exhibit a sufficient advantage even if the heat generating resistance layer or the electrodes are independently used, when they are used in combination, the advantage thereof can be further improved in multiplication.

On the other hand, a protection layer is composed of a multi-layer including a conventional insulation layer, liquid-resistant layer, and cavitation-resistant layer provided for each function. In the present invention, however, electric erosion caused from defective portions such as pin holes, which has been conventionally a particular problem, can be securely prevented by forming at least the portion of the protection layer in contact with ink mainly of an organic resinate containing an inorganic material conventionally used for the protection layer. In particular, since the cavitation-resistant layer coming into contact with the ink as a heat acting portion must be composed of a material excellent in mechanical shock resistance, a thermally and chemically stable metal material such as Ta, W, Pt or the like is used, and a protection layer having a stable resistance to mechanical shock even at a high temperature can be formed by forming the cavitation-resistant layer mainly of an organic resinate containing these materials.

Needless to say, the advantage of the present application can be further improved by using the aforesaid heat generating resistance layer and electrodes together in addition to the protection layer.

According to the present invention, a cost for forming the thin film, when compared with a cost for forming the same by a vacuum film forming method, can be greatly reduced to about ⅛ with respect to the heat generating resistance layer, about 1/10 with respect to the electrodes, and 1/12 with respect to the protection layer. Further, the thin film can be formed at a lower cost as compared with the case in which the film is formed of a dispersed organic material and glass used in a conventional printing method, coating method and the like, and the reliability of the thus formed film is improved.

The thin film composed mainly of the organic resinate according to the present invention is formed in such a process that a paste composed mainly of the organic resinate is coated on a substrate by a coating method, printing method or the like and then dried to remove the solvent contained in the paste and further baked in an atmosphere containing a sufficient amount of oxygen at 350° C. or higher or preferably at 600° C. or higher to remove a resin component contained in the paste.

Figure 5:
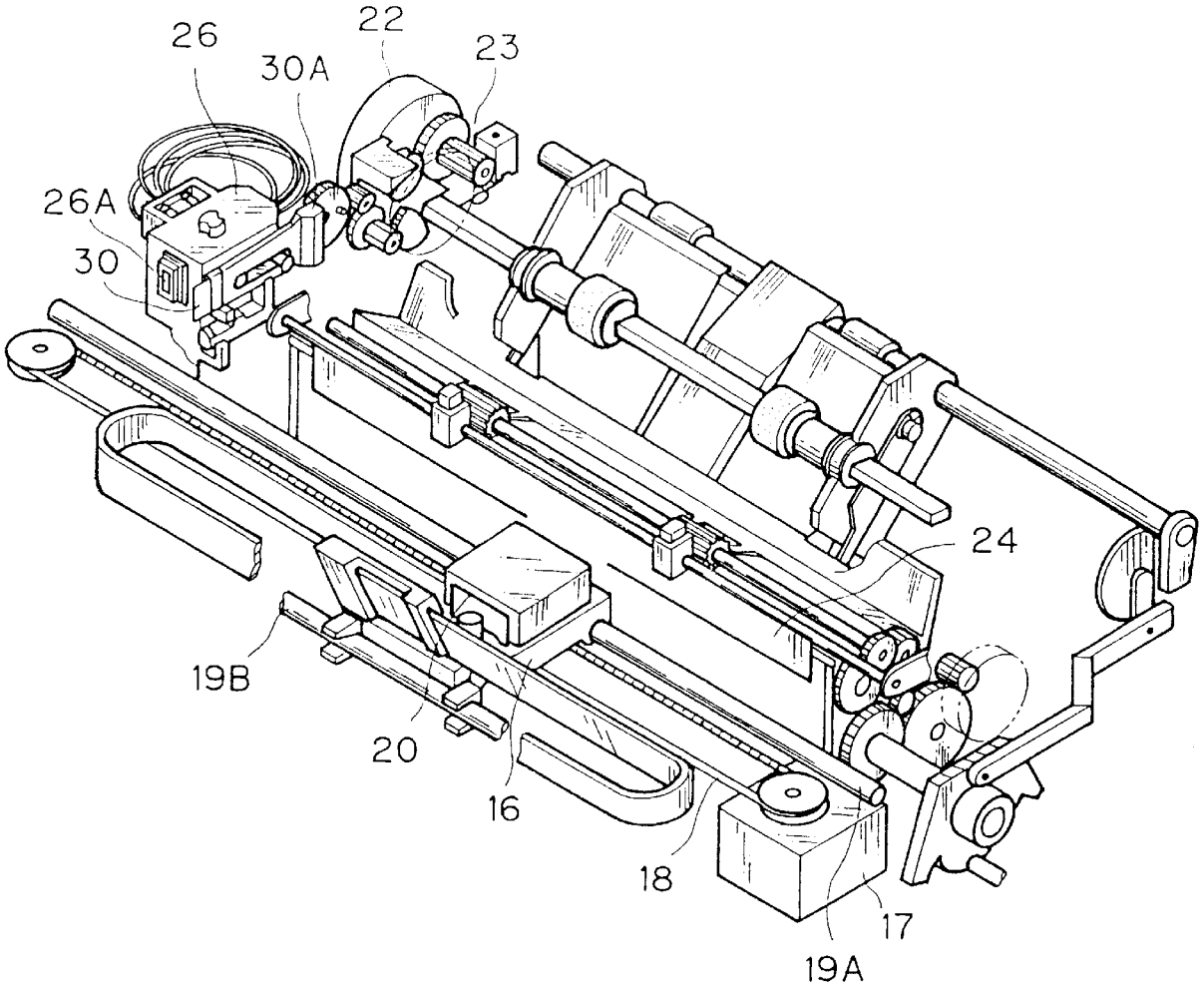
FIG. 5 is an outside perspective view showing an example of an ink jet recording apparatus to which a recording head of the present invention is mounted as an ink jet head cartridge.

FIG. 5 is an outside perspective view showing an example of an ink jet recording apparatus (IJRA) on which a recording head obtained by the present invention is mounted as an ink jet head cartridge (hereinafter, abbreviated as IJC).

In FIG. 5, reference numeral 20 designates the ink jet head cartridge (IJC) having a group of nozzles for jetting ink in confrontation with the recording surface of a recording paper fed onto a platen 24. Numeral 16 designates a carriage HC for holding the IJC 20. The carriage 16 is connected to a portion of a drive belt 18 for transmitting the drive force of a drive motor 17 so that it can slide along two guide shafts 19A and 19B disposed in parallel to each other. With this arrangement, the carriage 16 can reciprocatingly move over the entire width of the recording paper.

Numeral 26 designates a head recovery unit disposed at an end of the moving path of the IJC 20, e.g., a position confronting the home position thereof. The IJC 20 is capped by operating the head recovery unit 26 by the drive force of a motor 22 through a power transmission mechanism 23. A jet capability recovery processing is performed in such a manner that ink is sucked by a suitable sucking means provided with the head recovery unit 26 or fed under pressure by a suitable pressurizing means provided with an ink feed path to the IJC 20, in association with the capping of the IJC 20 effected by the cap portion 26A of the head recovery unit 26, to forcibly discharge ink from a jet port to thereby remove ink with an increased viscosity in the nozzles. In addition, the IJC is protected by performing capping upon the completion of recording, and the like.

Numeral 30 designates a blade as a wiping member formed of silicon rubber and disposed on the side surface of the head recovery unit 26. The blade 30 is cantilevered by a blade holding member 30A, operated by the motor 22 and a transmission mechanism 23 in the same way as the head recovery unit 26, and can be engaged with the jet surface of the IJC 20. With this arrangement, the blade 30 is projected into the moving path of the IJC 20 at a proper timing in the recording operation of the IJC 20 or after the jet capability recovery processing effected by using the head recovery unit 26, to wipe dew drops, wetting, dust and the like on the jet surface of the IJC 20 which are produced as the IJC 20 is moved in operation.

EXAMPLES

The present invention will be described below in detail with reference to examples.

FIG. 1 is a schematic partial cross sectional view showing the layer arrangement of the heater board of a recording head made by Examples 1–23. The cross sectional position of the heater board is shown by the cross sectional line 1—1 of the schematic partial plan view of FIG. 2 In FIG. 1, the heater board is arranged such that a heat accumulation layer 102, heat generating resistance layer 103, electrode layers 104, first protection layer 105, second protection layer 106, and third protection layer 107 are sequentially laminated at the predetermined positions on a substrate 101. The heat generating resistance layer 103 between the electrodes serves as a heat generating portion 201.

Examples 1–5

First, the substrate 101 was composed of silicon, and thermally oxidized $SiO_2$ was formed on the substrate 101 to a thickness of 2.0 microns as the heat accumulation layer 102. Then, the heat generating resistance layer 103 was spin coated on the heat accumulation layer 102 by using the conditions and materials shown in Table 1. Note, metal resinates made by Engelthard Co., Ltd. (trade names are shown in Table 1) were used as an organic resinate for the material of the heat generating resistance layer 103. In the spin coating, the organic resinate was diluted with chloromethane to provide the material with a predetermined viscosity.

Figure 2:
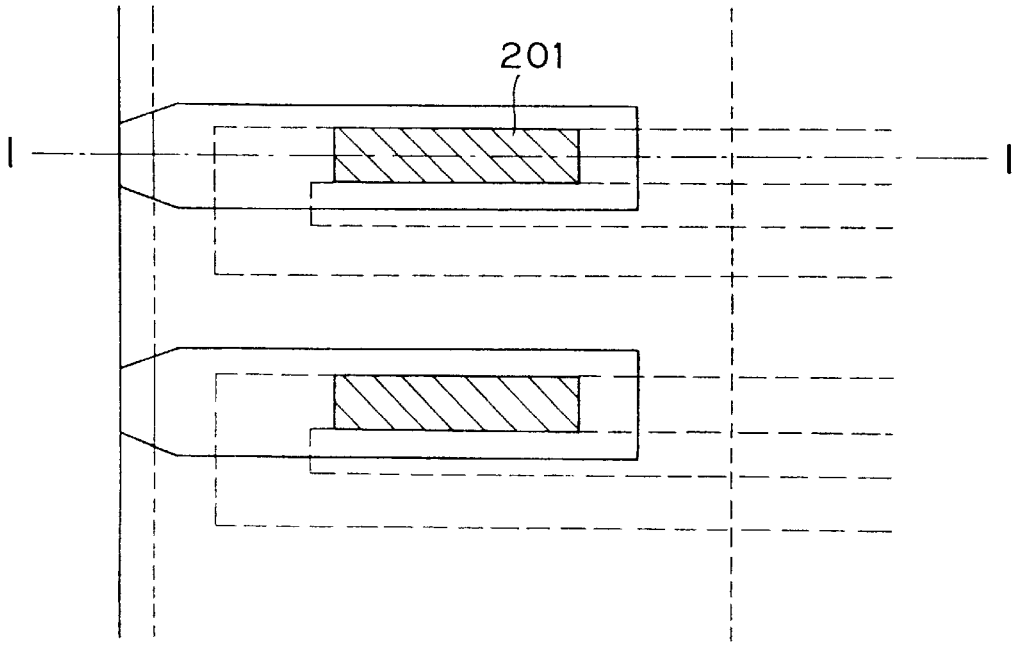
FIG. 2 is a schematic plan view showing the position and the like of the cross sectional line 1—1 in the cross sectional view in FIG. 1.

Next, Al was formed on the heat generating resistance layer 103 to a film thickness of 0.6 micron by vapor deposition and a circuit pattern shown by the dotted line in FIG. 2 was formed by photolithography as the electrode layers 104. In addition, with the formation of the electrode layers 104, the heat generating portion 201 was also formed between the electrodes in the size of 30 microns×150 microns. Then, $SiO_2$ was sputtered on the electrode layers 104 to a film thickness of 1.0 micron as the first protection layer 105. Further, Ta was sputtered on the first protection layer 105 to a film thickness of 0.5 micron and formed to a bar-shaped pattern as shown by the solid line in FIG. 2 by photolithography as the second protection layer 106. Further, heat sensitive polyimide was coated on the second protection layer 106 and formed to a pattern having a shape shown in FIG. 1 as the third protection layer 107. The heater board was completed by the above process.

Further, a predetermined nozzle flow path, ink chamber, ink feed port, ink jet port (40 microns×40 microns) were formed on the heater board by a usual operation to complete a liquid jet recording head.

Comparative Example 1

A liquid jet recording head was made by the same way as that of Example 1 except that a heat generating resistance layer 103 was not formed of an organic resinate but formed by sputtering $Ta_2N$ to a film thickness of 0.2 micron.

Comparative Example 2

A liquid jet recording head was made by the same way as that of Example 2 except that a heat generating resistance layer 103 was not formed of an organic resinate but formed by using dispersed ruthenium oxide and glass formed to a thickness of about 2 microns by a printing method and that a first protection layer 105 was formed to a film thickness of 3 microns for an ink shut-off property.

TABLE 1

| | Target Resistance Member | | Organic Resinate (Trade Name) | Viscosity After Adjustment |
|---|---|---|---|---|
| Example 1 | $ZrB_2$ | Zr#5437<br>B#11-A | Composed Mainly of Carboxylate<br>Composed Mainly of Boric Acid Compound | 10 cp |

TABLE 1-continued

| | | | | |
|---|---|---|---|---|
| Example 2 | $TiB_2$ | Ti#9428 | Composed Mainly of Carboxylate | 7 cp |
| | | B#11-A | Composed Mainly of Boric Acid Compound | |
| Example 3 | $Ta_2Si$ | Ta#7522 | Composed Mainly of Carboxylate | 12 cp |
| | | Si#28-FC | Composed Mainly of Siloxane | |
| Example 4 | $Ti_2Si$ | Ti#9428 | Composed Mainly of Carboxylate | 10 cp |
| | | Si#28-FC | Composed Mainly of Siloxane | |
| Example 5 | TaAl | Ta#7522 | Composed Mainly of Carboxylate | 8 cp |
| | | Al A-3808 | Composed Mainly of Carboxylate | |

| | Spinner Coating Conditions | | | | Final Film Thickness |
|---|---|---|---|---|---|
| | 1st | 2nd | Baking Conditions | | Sheet Resistance |
| Example 1 | 500 rpm | 5000 rpm | Room Temp. | 10 min. | 2000 Å |
| | 5 sec. | 30 sec. | 120° C. | 10 min. | 15 Ω/□ |
| | | | 750° C. | 10 min. | |
| Example 2 | 500 rpm | 5000 rpm | Room Temp. | 10 min. | 1300 Å |
| | 5 sec. | 30 sec. | 120° C. | 10 min. | 25 Ω/□ |
| | | | 750° C. | 10 min. | |
| Example 3 | 500 rpm | 5000 rpm | Room Temp. | 10 min. | 2300 Å |
| | 5 sec. | 30 sec. | 120° C. | 10 min. | 10 Ω/□ |
| | | | 850° C. | 10 min. | |
| Example 4 | 500 rpm | 5000 rpm | Room Temp. | 10 min. | 2000 Å |
| | 5 sec. | 30 sec. | 120° C. | 10 min. | 20 Ω/□ |
| | | | 850° C. | 10 min. | |
| Example 5 | 500 rpm | 5000 rpm | Room Temp. | 10 min. | 1500 Å |
| | 5 sec. | 30 sec. | 120° C. | 10 min. | 18 Ω/□ |
| | | | 850° C. | 10 min. | |

<Evaluation of Bubbling Characteristics>

Bubbling states of ink in response to a recording signal with a driving frequency of 10 Hz–50 kHz were visually observed for evaluation with respect to the respective recording heads made by Examples 1–5 and Comparative Examples 1–2. The result of the evaluation is shown in Table 2.

As shown in Table 2, the recording head of Comparative Example 1 has an unstable bubbling state at the driving frequency of 50 kHz. The recording head of Comparative Example 2 has an unstable bubbling state at the driving frequency of 10 kHz and a very unstable bubbling state at the driving frequency of 100 Hz or higher. On the other hand, the recording heads of Examples 1–5 have a stable ink bubbling state even at a high driving frequency because the heat generating resistance layer 103 has a small thermal capacity and thus the first protection layer 105 may be thin.

<Evaluation of Durability Against Thermal Stress>

A recording signal was imposed on the respective recording heads made by Examples 1–5 and Comparative Example 1 under the conditions of driving frequency=5.0 kHz, rectangular pulse width=10 microseconds, driving voltage=bubbling voltage×1.4 and durability against thermal stress was evaluated by the broken pulses thereof. The result of the evaluation is shown in Table 3.

As shown in Table 3, the recording heads of Examples 1–5 and the recording head of Comparative Example 1 have broken pulses of an order of $10^8$–$10^9$ and thus they have the same durability against thermal stress. More specifically, even if the heat generating resistance layer is formed by coating, the durability thereof is not inferior to that of a heat generating resistance layer made by a vacuum thin film forming process.

TABLE 2

| | Driving Frequency | | | | | | |
|---|---|---|---|---|---|---|---|
| | 10 Hz | 100 Hz | 500 Hz | 1 kHz | 5 kHz | 10 kHz | 50 kHz |
| Example 1 | ○ | ○ | ○ | ○ | ○ | ○ | Δ |
| Example 2 | ○ | ○ | ○ | ○ | ○ | ○ | Δ |
| Example 3 | ○ | ○ | ○ | ○ | ○ | ○ | Δ |
| Example 4 | ○ | ○ | ○ | ○ | ○ | ○ | Δ |
| Example 5 | ○ | ○ | ○ | ○ | ○ | ○ | Δ |
| Comparative Example 1 | ○ | ○ | ○ | ○ | ○ | ○ | Δ |
| Comparative Example 2 | Δ | x | x | x | x | x | x |

○ normal bubbling
Δ unstable bubbling
x very unstable bubbling

TABLE 3

| | Broken Pulses |
|---|---|
| Example 1 | $3 \times 10^8$ |
| Example 2 | $5 \times 10^8$ |
| Example 3 | $1 \times 10^9$ |
| Example 4 | $3 \times 10^8$ |
| Example 5 | $2 \times 10^8$ |
| Comparative Example 1 | $3 \times 10^8$ |

Examples 6–7

A substrate 101 was composed of silicon, and thermally oxidized $SiO_2$ was formed on the substrate 101 to a thickness of 2.0 microns as a heat accumulation layer 102. Then, $HfB_2$ was sputtered on the heat accumulation layer 102 to a film thickness of 0.1 micron as a heat generating resistance layer 103. A layer serving as electrode layers were spin coated on the heat generating resistance layer 103 by using the conditions and materials shown in Table 4. Note, metal resinates made by Engelthard Co., Ltd. (trade names are shown in Table 4) were used as an organic resinate for the material of the layers. Further, in the spin coating, the organic resinate was diluted with chloromethane to provide the material with a predetermined viscosity. The layer was formed to a circuit pattern shown by the dotted line of FIG. 2 to make the electrode layers 104. In addition, with the formation of the electrode layers 104, a heat generating portion 201 was also formed between the electrodes in the size of 30 microns×150 microns. Then, $SiO_2$ was sputtered on the electrode layers 104 to a film thickness of 1.0 micron as a first protection layer 105. Further, Ta was sputtered on the first protection layer 105 to a film thickness of 0.5 micron and formed to a bar-shaped pattern as shown by the solid line in FIG. 2 by photolithography to form a second protection layer 106. Further, heat sensitive polyimide was coated on the second protection layer 106 and formed to a pattern having a shape shown in FIG. 1 to form a third protection layer 107. A heater board was completed by the above process.

Further, a predetermined nozzle flow path, ink chamber, ink feed port, ink jet port (40 microns×40 microns) were formed on the heater board by a usual operation to complete a liquid jet recording head.

Comparative Example 3

A liquid jet recording head was made by the same way as that of Example 6 except that electrode layers 104 were not formed of an organic resinate but formed to a film thickness of 0.6 micron by vacuum evaporating Al.

Comparative Example 4

A liquid jet recording head was made by the same way as that of Example 6 except that electrode layers 104 were not formed of an organic resinate but formed by using dispersed Au and glass formed to a thickness of about 2 microns by a printing method and that a first protection layer 105 was formed to a film thickness of 3 microns for an ink shut-off property.

TABLE 4

| | Target Electrode | | Organic Resinate (Trade Name) | | Viscosity After Adjustment |
|---|---|---|---|---|---|
| Example 6 | Au | Au A-1118 | Composed Mainly of Carboxylate | | 15 cp |
| Example 7 | A1 | A1 A-3808 | Composed Mainly of Carboxylate | | 11 cp |
| | Spinner Coating Conditions | | | | Final Film Thickness |
| | 1st | 2nd | Baking Conditions | | Sheet Resistance |
| Example 6 | 500 rpm | 3000 rpm | Room Temp. | 10 min. | 10000 Å |
| | 5 sec. | 30 sec. | 120° C. | 10 min. | 0.07 Ω/□ |
| | | | 850° C. | 10 min. | |
| Example 7 | 500 rpm | 3000 rpm | Room Temp. | 10 min. | 7000 Å |
| | 5 sec. | 30 sec. | 120° C. | 10 min. | 0.05 Ω/□ |
| | | | 550° C. | 10 min. | |

<Evaluation of Bubbling Characteristics>

Bubbling states of ink in response to a recording signal with a driving frequency of 10 Hz–50 kHz were visually observed for evaluation with respect to the respective recording heads made by Examples 6–7 and Comparative Examples 3–4. The result of the evaluation is shown in Table 5.

As shown in Table 5, the recording head of Comparative Example 3 has an unstable bubbling state at the driving frequency of 50 kHz. The recording head of Comparative Example 4 has an unstable bubbling state at the driving frequency of 10 kHz and a very unstable bubbling state at the driving frequency of 100 Hz or higher. On the other hand, the recording heads of Examples 6–7 have a stable ink bubbling state even at a high driving frequency because the first protection layer 105 may be thin.

TABLE 5

| | Driving Frequency | | | | | | |
|---|---|---|---|---|---|---|---|
| | 10 Hz | 100 Hz | 500 Hz | 1 kHz | 5 kHz | 10 kHz | 50 kHz |
| Example 6 | ○ | ○ | ○ | ○ | ○ | ○ | Δ |
| Example 7 | ○ | ○ | ○ | ○ | ○ | ○ | Δ |
| Comparative Example 3 | ○ | ○ | ○ | ○ | ○ | ○ | Δ |
| Comparative Example 4 | Δ | x | x | x | x | x | x |

○ normal bubbling
Δ unstable bubbling
x very unstable bubbling

<Evaluation of Durability Against Thermal Stress>

A recording signal was imposed on the respective recording heads made by Examples 6–7 and Comparative Example 1 under the conditions of driving frequency=5.0 kHz, rectangular pulse width=10 microseconds, driving voltage=bubbling voltage×1.4 and durability against thermal stress was evaluated by the broken pulse thereof. The result of the evaluation is shown in Table 6.

As shown in Table 6, the recording heads of Examples 6–7 and the recording head of Comparative Example 3 have broken pulses of an order of $10^8$ and thus they have the same durability against thermal stress. More specifically, even if the electrode layers are formed by coating, the durability thereof is not inferior to that of electrode layers made by a vacuum thin film forming process.

TABLE 6

| | Broken Pulses |
|---|---|
| Example 6 | $7 \times 10^8$ |
| Example 7 | $6 \times 10^8$ |
| Comparative Example 3 | $7 \times 10^8$ |

Examples 8–12

A substrate 101 was composed of silicon, and thermally oxidized $SiO_2$ was formed on the substrate 101 to a thickness of 2.0 microns as a heat accumulation layer 102. Then, a heat generating resistance layer 103 was spin coated on the heat accumulation layer 102 by using the conditions and materials shown in Table 7. Note, metal resinates made by Engelthard Co., Ltd. (trade names are shown in Table 7) were used as an organic resinate for the material of the heat generating resistance layer 103. In the spin coating, the organic resinate was diluted with chloromethane to provide the material with a predetermined viscosity.

An organic resinate material for Al, which was obtained by diluting a metal resinate made by Engelthard Co., Ltd. (trade name: A-3808, composed mainly of carboxylate) with chloromethane to a viscosity of 11 cp, was spin coated on the heat generating resistance layer 103 under the coating conditions of a first step; 500 rpm×5 seconds and a second step; 3000 rpm×30 seconds. The coated film was baked at a room temperature for 10 minutes, at 120° C. for 10 minutes and at 550° C. for 10 minutes. Then, an Al thin layer having a final film thickness of 0.7 micron and a sheet resistance of 0.05 ohm/□ was formed for electrode layers. Then, the Al thin film was formed to a circuit pattern shown by the dotted line in FIG. 2 by photolithography to form the electrode layers 104. In addition, with the formation of the electrode layers 104, a heat generating portion 201 was also formed between the electrodes in the size of 30 microns×150 microns. Then, $SiO_2$ was sputtered on the electrode layers 104 to a film thickness of 1.0 micron as a first protection layer 105. Further, Ta was sputtered on the first protection layer 105 to a film thickness of 0.5 micron and formed to a bar-shaped pattern as shown by the solid line in FIG. 2 by photolithography to form a second protection layer 106. Further, heat sensitive polyimide was coated on the second protection layer 106 and formed to a pattern having a shape shown in FIG. 1 to form a third protection layer 107. A heater board was completed by the above process.

Further, a predetermined nozzle flow path, ink chamber, ink feed port, ink jet port (40 microns×40 microns) were formed on the heater board by a usual operation to complete a liquid jet recording head.

Comparative Example 5

A liquid jet recording head was made by the same way as that of Example 8 except that a heat generating resistance layer 103 and electrode layers 104 were not formed of an organic resinate but the former wag formed by sputtering $Ta_2N$ to a film thickness of 0.2 micron and the latter was formed by vacuum evaporating Al to a film thickness of 0.6 micron.

Comparative Example 6

A liquid jet recording head was made by the same way as that of Example 8 except that a heat generating resistance layer 103 and electrode layers 104 were not formed of an organic resinate but the former was formed by using dispersed ruthenium oxide and glass formed to a thickness of about 2 microns by a printing method and the latter was formed by using dispersed Au and glass formed to a thickness of about 2 microns by a printing method and that a first protection layer 105 was formed to a film thickness of 4 microns for an ink shut-off property.

TABLE 7

| | Target Resistance Member | | Organic Resinate (Trade Name) | Viscosity After Adjustment |
|---|---|---|---|---|
| Example 8 | $ZrB_2$ | Zr#5437 | Composed Mainly of Carboxylate | 10 cp |
| | | B#11-A | Composed Mainly of Boric Acid Compound | |
| Example 9 | $TiB_2$ | Ti#9428 | Composed Mainly of Carboxylate | 7 cp |
| | | B#11-A | Composed Mainly of Boric Acid Compound | |
| Example 10 | $Ta_2Si$ | Ta#7522 | Composed Mainly of Carboxylate | 12 cp |
| | | Si#28-FC | Composed Mainly of Siloxane | |
| Example 11 | $Ti_2Si$ | Ti#9428 | Composed Mainly of Carboxylate | 10 cp |
| | | Si#28-FC | Composed Mainly of Siloxane | |
| Example 12 | TaAl | Ta#7522 | Composed Mainly of Carboxylate | 8 cp |
| | | Al A-3808 | Composed Mainly of Carboxylate | |

| | Spinner Coating Conditions | | | | Final Film Thickness |
|---|---|---|---|---|---|
| | 1st | 2nd | Baking Conditions | | Sheet Resistance |
| Example 8 | 500 rpm | 5000 rpm | Room Temp. | 10 min. | 2000 Å |
| | 5 sec. | 30 sec. | 120° C. | 10 min. | 15 Ω/□ |
| | | | 750° C. | 10 min. | |
| Example 9 | 500 rpm | 5000 rpm | Room Temp. | 10 min. | 1300 Å |
| | 5 sec. | 30 sec. | 120° C. | 10 min. | 25 Ω/□ |
| | | | 750° C. | 10 min. | |
| Example 10 | 500 rpm | 5000 rpm | Room Temp. | 10 min. | 2300 Å |
| | 5 sec. | 30 sec. | 120° C. | 10 min. | 10 Ω/□ |
| | | | 850° C. | 10 min. | |
| Example 11 | 500 rpm | 5000 rpm | Room Temp. | 10 min. | 2000 Å |
| | 5 sec. | 30 sec. | 120° C. | 10 min. | 20 Ω/□ |
| | | | 850° C. | 10 min. | |
| Example 12 | 500 rpm | 5000 rpm | Room Temp. | 10 min. | 1500 Å |
| | 5 sec. | 30 sec. | 120° C. | 10 min. | 18 Ω/□ |
| | | | 850° C. | 10 min. | |

<Evaluation of Bubbling Characteristics>

Bubbling states of ink in response to a recording signal with a driving frequency of 10 Hz–50 kHz were visually observed for evaluation with respect to the respective recording heads made by Examples 8–12 and Comparative Examples 5–6. The result of the evaluation is shown in Table 8.

TABLE 8

| | Driving Frequency | | | | | | |
|---|---|---|---|---|---|---|---|
| | 10 Hz | 100 Hz | 500 Hz | 1 kHz | 5 kHz | 10 kHz | 50 kHz |
| Example 8 | ○ | ○ | ○ | ○ | ○ | ○ | Δ |
| Example 9 | ○ | ○ | ○ | ○ | ○ | ○ | Δ |
| Example 10 | ○ | ○ | ○ | ○ | ○ | ○ | Δ |
| Example 11 | ○ | ○ | ○ | ○ | ○ | ○ | Δ |
| Example 12 | ○ | ○ | ○ | ○ | ○ | ○ | Δ |
| Comparative Example 5 | ○ | ○ | ○ | ○ | ○ | ○ | Δ |
| Comparative Example 6 | Δ | x | x | x | x | x | x |

○ normal bubbling
Δ unstable bubbling
x very unstable bubbling

As shown in Table 8, the recording head of Comparative Example 5 has an unstable bubbling state at the driving frequency of 50 kHz. The recording head of Comparative Example 6 has an unstable bubbling state at the driving frequency of 10 kHz and a very unstable bubbling state at the driving frequency of 100 Hz or higher. On the other hand, the recording heads of Examples 8–12 have a stable ink bubbling state even at a high driving frequency because the heat generating resistance layer 103 has a small heat capacity and thus the first protection layer 105 may be thin.

<Evaluation of Durability Against Thermal Stress>

A recording signal was imposed on the respective recording heads made by Examples 8–12 and Comparative Example 5 under the conditions of driving frequency=5.0 kHz, rectangular pulse width=10 microseconds, driving voltage=bubbling voltage×1.4 and durability against thermal stress was evaluated by the broken pulses thereof. The result of the evaluation is shown in Table 9.

As shown in Table 9, the recording heads of Examples 8–12 and the recording head of Comparative Example 5 have broken pulses of an order of $10^8$–$10^9$ and thus they have the same durability against thermal stress. More specifically, even if the heat generating resistance layer and electrode layers are formed by coating, the durability thereof is not inferior to that of a heat generating resistance layer and electrode layers made by a vacuum thin film forming process.

TABLE 9

| | Broken Pulses |
|---|---|
| Example 8 | $3 \times 10^8$ |
| Example 9 | $5 \times 10^8$ |
| Example 10 | $1 \times 10^9$ |
| Example 11 | $3 \times 10^8$ |
| Example 12 | $2 \times 10^8$ |
| Comparative Example 5 | $3 \times 10^8$ |

Examples 13–17

A substrate 101 was composed of silicon, and thermally oxidized $SiO_2$ was formed on the substrate 101 to a thickness of 2.0 microns as a heat accumulation layer 102. Then, $HfB_2$ was sputtered on the heat accumulation layer 102 to a film thickness of 0.2 micron as a heat generating resistance layer 103. Then, Al was vacuum evaporated on the heat generating resistance layer 103 to a thickness of 0.6 micron and formed to a circuit pattern shown by the dotted line in FIG. 2 by photolithography to form electrode layers 104. With the formation of the electrode layers 104, a heat generating portion 201 was also formed in the size of 30 microns×150 microns. Then, $SiO_2$ was sputtered on the electrode layers 104 to a film thickness of 1.0 micron as a first protection layer 105. A second protection layer (an upper protection layer in contact with ink on a heat acting portion) was formed by spin coating by using the conditions and materials shown in Table 10. Note, metal resinates made by Engelthard Co., Ltd. (trade names are shown in Table 10) were used as an organic resinate for the material of the layer. Further, in the spin coating, the organic resinate was diluted with chloromethane to provide the material with a predetermined viscosity. Then, the layer was formed to a bar-shaped pattern shown by the solid line of in FIG. 2 to make it a second protection layer 106. Further, heat sensitive polyimide was coated on the second protection layer 106 and formed to a pattern having a shape shown in FIG. 1 to form a third protection layer 107. A heater board was completed by the above process.

Further, a predetermined nozzle flow path, ink chamber, ink feed port, ink jet port (40 microns×40 microns) were formed on the heater board by a usual operation to complete a liquid jet recording head.

Comparative Example 7

A liquid jet recording head was made by the same way as that of Example 13 except that a second protection layer 106 was not formed of an organic resinate but formed to a film thickness of 0.5 micron by sputtering Ta.

Comparative Example 8

A liquid jet recording head was made by the same way as that of Example 13 except that a second protection layer 106 was not formed of an organic resinate but formed to a thickness of about 2 microns by a printing method by using dispersed Ta and glass.

TABLE 10

| | Target Protective Layer Material | | Organic Resinate (Trade Name) | Viscosity After Adjustment |
|---|---|---|---|---|
| Example 13 | Ta | Ta #7522 | Composed Mainly of Carboxylate | 20 cp |
| Example 14 | Pt | Pt #9450 | Composed Mainly of Carboxylate | 25 cp |
| Example 15 | Ti | Ti #9428 | Composed Mainly of Carboxylate | 18 cp |
| Example 16 | Mo | Mo #8605 | Mainly composed of Carboxylate | 30 cp |
| Example 17 | w | W #8629 | Composed Mainly of Carboxylate | 20 cp |

| | Spinner Coating Conditions | | | | |
|---|---|---|---|---|---|
| | 1st | 2nd | Baking Conditions | | Final Film Thickness |
| Example 13 | 500 rpm<br>5 sec. | 3000 rpm<br>30 sec. | Room Temp.<br>120° C.<br>950° C. | 10 min.<br>10 min.<br>10 min. | 5500 Å |
| Example 14 | 500 rpm<br>5 sec. | 3500 rpm<br>30 sec. | Room Temp.<br>120° C.<br>950° C. | 10 min.<br>10 min.<br>10 min. | 5000 Å |
| Example 15 | 500 rpm<br>5 sec. | 3000 rpm<br>30 sec. | Rooin Temp.<br>120° C.<br>850° C. | 10 min.<br>10 min.<br>10 min. | 5000 Å |
| Example 16 | 500 rpm<br>5 sed. | 4000 rpm<br>30 sec. | Room Temp.<br>120° C.<br>950° C. | 10 min.<br>10 min.<br>10 min. | 4000 Å |
| Example 17 | 500 rpm<br>5 sec. | 3000 rpm<br>30 sec. | Room Temp.<br>120° C.<br>950° C. | 10 min.<br>10 min.<br>10 min. | 5500 Å |

<Evaluation of Bubbling Characteristics>

Bubbling states of ink in response to a recording signal with a driving frequency of 10 Hz–50 kHz were visually observed for evaluation with respect to the respective recording heads made by Examples 13–17 and Comparative Examples 7–8. The result of the evaluation is shown in Table 11.

As shown in Table 11, the recording head of Comparative Example 7 has an unstable bubbling state at the driving frequency of 50 kHz. The recording head of Comparative Example 8 has an unstable bubbling state at the driving frequency of 10 kHz and a very unstable bubbling state at the driving frequency of 100 Hz or higher. On the other hand, the recording heads of Examples 13–17 have a stable ink bubbling state even at a high driving frequency because the second protection layer 106 has a large heat transfer coefficient and is thin.

TABLE 11

| | Driving Frequency | | | | | | |
|---|---|---|---|---|---|---|---|
| | 10 Hz | 100 Hz | 500 Hz | 1 kHz | 5 kHz | 10 kHz | 50 kHz |
| Example 13 | ○ | ○ | ○ | ○ | ○ | ○ | Δ |
| Example 14 | ○ | ○ | ○ | ○ | ○ | ○ | Δ |
| Example 15 | ○ | ○ | ○ | ○ | ○ | ○ | Δ |
| Example 16 | ○ | ○ | ○ | ○ | ○ | ○ | Δ |
| Example 17 | ○ | ○ | ○ | ○ | ○ | ○ | Δ |
| Comparative Example 7 | ○ | ○ | ○ | ○ | ○ | ○ | Δ |
| Comparative Example 8 | Δ | x | x | x | x | x | x |

○ normal bubbling
Δ unstable bubbling
x very unstable bubbling

<Evaluation of Durability Against Jet Operation>

A recording signal was imposed on the respective recording heads made by Examples 13–17 and Comparative Example 7 under the conditions of driving frequency=2.0 kHz, rectangular pulse width=10 microseconds, driving voltage=bubbling voltage×1.15 and drive segment=500 bits, and durability against jet operation was evaluated by the number of broken segments thereof. The result of the evaluation is shown in Table 12.

As shown in Table 12, the recording heads of Examples 13–17 and the recording head of Comparative Example 7 have no broken segment even at $1\times10^9$ and thus they have the same durability against jet operation. More specifically, even if the upper protection layer is formed by coating, the durability thereof is not inferior to that of an upper protection layer made by a vacuum thin film forming process.

TABLE 12

| | Number of Broken Segments | | | |
|---|---|---|---|---|
| Number of Pulses | $1\times10^8$ | $3\times10^8$ | $5\times10^8$ | $1\times10^9$ |
| Example 13 | 0 | 0 | 0 | 0 |
| Example 14 | 0 | 0 | 0 | 0 |
| Example 15 | 0 | 0 | 0 | 0 |
| Example 16 | 0 | 0 | 0 | 0 |
| Example 17 | 0 | 0 | 0 | 0 |
| Comparative Example 7 | 0 | 0 | 0 | 0 |

Examples 18–23

A substrate 101 was composed of silicon, and thermally oxidized $SiO_2$ was formed on the substrate 101 to a thickness of 2.0 microns as a heat accumulation layer 102. Then, a heat generating resistance layer 103 was spin coated on the heat accumulation layer 102 by using the conditions and materials shown in Table 13. Note, metal resinates made by Engelthard Co., Ltd. (trace names are shown in Table 13) were used as an organic resinate for the material of the heat generating resistance layer 103. In the spin coating, the organic resinate was diluted with chloromethane to provide the material with a predetermined viscosity.

An organic resinate material for Al, which was obtained by diluting a metal resinate made by Engelthard Co., Ltd. (trade name: A-3808, composed mainly of carboxylate) with chloromethane to a viscosity of 11 cp, was spin coated on the heat generating resistance layer 103 under the coating conditions of a first step; 500 rpm×5 seconds and a second step; 3000 rpm×30 seconds. The coated film was baked at a room temperature for 10 minutes, at 120° C. for 10 minutes and at 550° C. for 10 minutes. Then, an Al thin layer having a final film thickness of 0.7 micron and a sheet resistance of 0.05 ohm/□ was formed for electrode layers. Then, the Al thin film was formed to a circuit pattern shown by the dotted line in FIG. 2 by photolithography to form the electrode layers 104. In addition, with the formation of the electrode layers 104, a heat generating portion 201 was also formed between electrodes in the size of 30 microns×150 microns.

Then, $SiO_2$ was sputtered on the electrode layers 104 to a film thickness of 1.0 micron as a first protection layer 105. A second protection layer (an upper protection layer in contact with ink on a heat acting portion) was formed by spin coating by using the conditions and materials shown in Table 13. Note, metal resinates made by Engelthard Co., Ltd. (trade names are shown in Table 13) were used as an organic resinate for the material of the layer. Further, in the spin coating, the organic resinate was diluted with chloromethane to provide the material with a predetermined viscosity. Then, the layer was formed to a bar-shaped pattern shown by the solid line of in FIG. 2 to make it a second protection layer 106. Further, heat sensitive polyimide was coated on the second protection layer 106 and formed to a pattern having a shape shown in FIG. 1 to form a third protection layer 107. A heater board was completed by the above process.

Further, a predetermined nozzle flow path, ink chamber, ink feed port, ink jet port (40 microns×40 microns) were formed on the heater board by a usual operation to complete a liquid jet recording head.

Comparative Example 9

A liquid jet recording head was made by the same way as that of Example 18 except that a heat generating resistance layer 103, electrode layers 104 and a second protection layer were not formed of an organic resinate but the heat generating resistance layer 103 was formed by sputtering $Ta_2N$ to a film thickness of 0.2 micron, the electrode layers 104 were formed by vacuum evaporating Al to a film thickness of 0.6 micron, and the second protection layer 106 was formed by sputtering Ta to a film thickness of 0.5 micron.

Comparative Example 10

A liquid jet recording head was made by the same way as that of Example 18 except that a heat generating resistance layer 103, electrode layers 104 and a second protection layer 106 were not formed of an organic resinate but the heat generating resistance layer 103 was formed by using dispersed ruthenium oxide and glass formed to a thickness of about 2 microns by a printing method, the electrode layers 104 were formed by using dispersed Au and glass formed to a thickness of about 2 microns by a printing method, and the second protection layer 106 was formed by using dispersed Ta and glass formed to a thickness of about 2 microns by a printing method and that a first protection layer 105 was formed to a film thickness of 4 microns for an ink shut-off property.

TABLE 13

| | Target Resistance Member | | Organic Resinate (Trade Name) | | Viscosity After Adjustment |
|---|---|---|---|---|---|
| Example 18, 21 | $ZrB_2$ | Zr#5437<br>B#11-A | Composed Mainly of Carboxylate<br>Composed Mainly of Boric Acid Compound | | 10 cp |
| Example 19, 22 | $TiB_2$ | Ti#9428<br>B#11-A | Composed Mainly of Carboxylate<br>Composed Mainly of Boric Acid Compound | | 7 cp |
| Example 20, 23 | $Ta_2Si$ | Ta#7522<br>Si#28-FC | Composed Mainly of Carboxylate<br>Composed Mainly of Siloxane | | 12 cp |
| | Spinner Coating Conditions | | | | Final Film Thickness |
| | 1st | 2nd | Baking Conditions | | Sheet Resistance |
| Example 18, 21 | 500 rpm<br>5 sec. | 5000 rpm<br>30 sec. | Room Temp.<br>120° C.<br>750° C. | 10 min.<br>10 min.<br>10 min. | 2000 Å<br>15 Ω/□ |
| Example 19, 22 | 500 rpm<br>5 sec. | 5000 rpm<br>30 sec. | Room Temp.<br>120° C.<br>750° C. | 10 min.<br>10 min.<br>10 min. | 1300 Å<br>25 Ω/□ |
| Example 20, 23 | 500 rpm<br>5 sec. | 5000 rpm<br>30 sec. | Room Temp.<br>120° C.<br>850° C. | 10 min.<br>10 min.<br>10 min. | 2300 Å<br>10 Ω/□ |

TABLE 14

| | Target Protective Layer Material | | Organic Resinate (Trade Name) | | Viscosity After Adjustment |
|---|---|---|---|---|---|
| Example 18, 19, 20 | Ta | Ta #7522 | Composed Mainly of Carboxylate | | 20 cp |
| Example 21, 22, 23 | Pt | Pt #9450 | Composed Mainly of Carboxylate | | 25 cp |
| | Spinner Coating Conditions | | | | |
| | 1st | 2nd | Baking Conditions | | Final Film Thickness |
| Example 18, 19, 20 | 500 rpm<br>5 sec. | 3000 rpm<br>30 sec. | Room Temp.<br>120° C.<br>950° C. | 10 min.<br>10 min.<br>10 min. | 5500 Å |
| Example 21, 22, 23 | 500 rpm<br>5 sec. | 3500 rpm<br>30 sec. | Room Temp.<br>120° C.<br>950° C. | 10 min.<br>10 min.<br>10 min. | 5000 Å |

<Evaluation of Bubbling Characteristics>

Bubbling states of ink in response to a recording signal with a driving frequency of 10 Hz–50 kHz were visually observed for evaluation with respect to the respective recording heads made by Examples 18–23 and Comparative Examples 9–10. The result of the evaluation is shown in Table 15.

As shown in Table 15, the recording head of Comparative Example 9 has an unstable bubbling state at the driving frequency of 50 kHz. The recording head of Comparative Example 10 has an unstable bubbling state at the driving frequency of 10 kHz and a very unstable bubbling state at the driving frequency of 100 Hz or higher. On the other hand, the recording heads of Examples 18–23 have a stable ink bubbling state even at a high driving frequency because the heat generating resistance layer 103 has a small heat capacity, the second protection layer 106 has a large heat transfer coefficient and a thin film thickness and thus the first protection layer 105 may be thin.

TABLE 15

| | Driving Frequency | | | | | | |
|---|---|---|---|---|---|---|---|
| | 10 Hz | 100 Hz | 500 Hz | 1 kHz | 5 kHz | 10 kHz | 50 kHz |
| Example 18 | ○ | ○ | ○ | ○ | ○ | ○ | Δ |
| Example 19 | ○ | ○ | ○ | ○ | ○ | ○ | Δ |
| Example 20 | ○ | ○ | ○ | ○ | ○ | ○ | Δ |
| Example 21 | ○ | ○ | ○ | ○ | ○ | ○ | Δ |
| Example 22 | ○ | ○ | ○ | ○ | ○ | ○ | Δ |
| Example 23 | ○ | ○ | ○ | ○ | ○ | ○ | Δ |
| Comparative Example 9 | ○ | ○ | ○ | ○ | ○ | ○ | Δ |
| Comparative Example 10 | Δ | x | x | x | x | x | |

○ normal bubbling
Δ unstable bubbling
x very unstable bubbling

<Evaluation of Durability Against Jet Operation>

A recording signal was imposed on the respective recording heads made by Examples 18–23 and Comparative Example 9 under the conditions of driving frequency=2.0 kHz, rectangular pulse width=10 microseconds, driving voltage=bubbling voltage×1.15 and drive segment=500 bits, and durability against jet operation was evaluated by the number of broken segments thereof. The result of the evaluation is shown in Table 16.

As shown in Table 16, the recording heads of Examples 18–23 and the recording head of Comparative Example 9 have no broken segment even at $1\times10^9$ and thus they have the same durability against jet operation. More specifically, even if the upper protection layer and the like are formed by coating, the durability thereof is not inferior to that of an upper protection layer and the like made by a vacuum thin film forming process.

TABLE 16

| | Number of Broken Segments | | | |
|---|---|---|---|---|
| Number of pulses | $1\times10^8$ | $3\times10^8$ | $5\times10^8$ | $1\times10^9$ |
| Example 18 | 0 | 0 | 0 | 0 |
| Example 19 | 0 | 0 | 0 | 0 |
| Example 20 | 0 | 0 | 0 | 0 |
| Example 21 | 0 | 0 | 0 | 0 |
| Example 22 | 0 | 0 | 0 | 0 |
| Example 23 | 0 | 0 | 0 | 0 |
| Comparative Example 9 | 0 | 0 | 0 | 0 |

Figure 3:
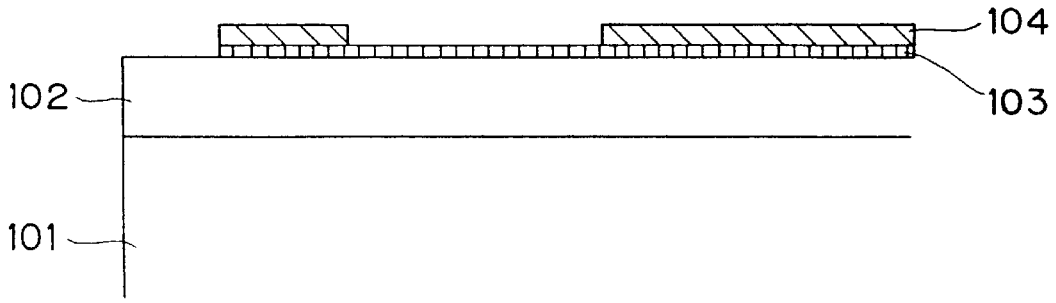
FIG. 3 is a schematic partial cross sectional view showing the layer arrangement of the heater board of a recording head made by Examples 24–35.

FIG. 3 is a schematic partial cross sectional view showing the layer arrangement of the heater board of a recording head made by Examples 24–35. The cross sectional position of the heater board is shown by the cross sectional line 3—3 of the schematic partial plan view of FIG. 4. In FIG. 3, the heater board is arranged such that a heat accumulation layer 102, heat generating resistance layer 103 and electrode layers 104 are sequentially laminated at the predetermined positions on a substrate 101. The heat generating resistance layer 103 between the electrodes serves as a heat generating portion 201.

Examples 24–28

First, the substrate 101 was composed of silicon, and thermally oxidized $SiO_2$ was formed on the substrate 101 to a thickness of 2.0 microns as the heat accumulation layer 102. Then, the heat generating resistance layer 103 was spin coated on the heat accumulation layer 102 by using the conditions and materials shown in Table 17. Note, metal resinates made by Engelthard Co., Ltd. (trade names are shown in Table 17) were used as an organic resinate for the material of the heat generating resistance layer 103. In the spin coating, the organic resinate was diluted with chloromethane to provide the material with a predetermined viscosity.

Figure 4:
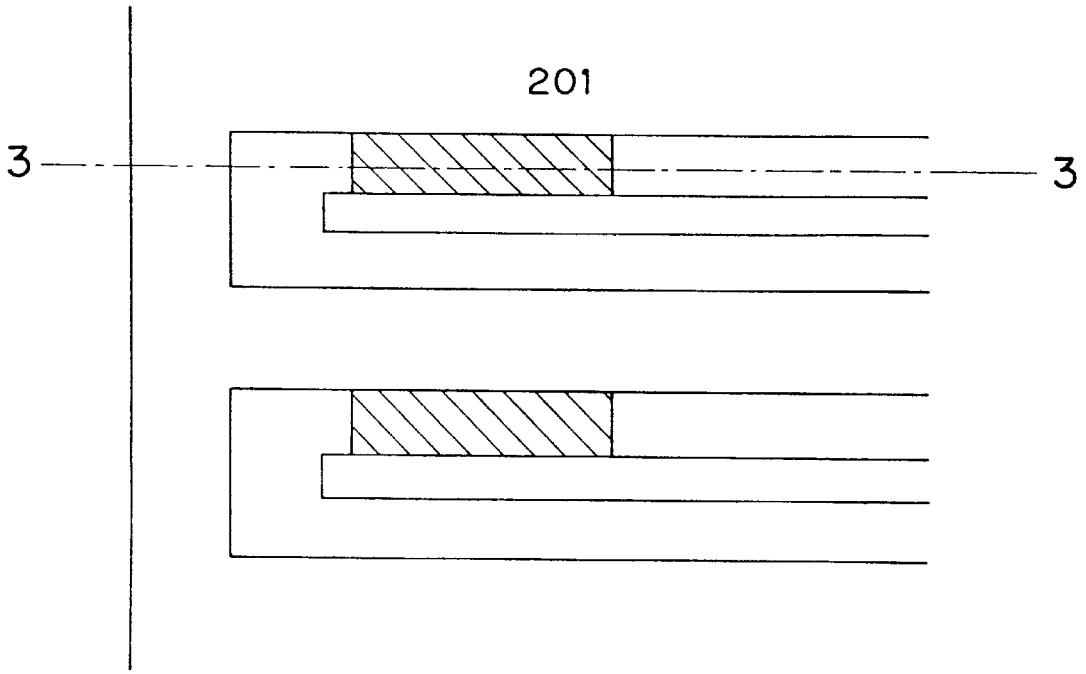
FIG. 4 is a schematic plan view showing the position and the like of the cross sectional line 3—3 in the cross sectional view in FIG. 3.

Next, chemically stable Au was formed on the heat generating resistance layer 103 to a film thickness of 0.6 micron by vapor deposition and a circuit pattern shown in FIG. 4 was formed by photolithography as the electrode layers 104. In addition, with the formation of the electrode layers 104, the heat generating portion 201 was also formed between the electrodes in the size of 30 microns×150 microns. The heater board was completed by the above process.

Further, a predetermined nozzle flow path, ink chamber, ink feed port, ink jet port (40 microns×40 microns) were formed on the heater board by a usual operation to complete a liquid jet recording head.

Comparative Example 11

A liquid jet recording head was made by the same way as that of Example 24 except that a heat generating resistance layer 103 was not formed of an organic resinate but formed by sputtering Al—Ta—Ir to a film thickness of 0.2 micron.

Comparative Example 12

A liquid jet recording head was made by the same way as that of Example 24 except that a heat generating resistance layer 103 was not formed of an organic resinate but formed by using dispersed iridium oxide and glass formed to a thickness of about 2 microns by a printing method.

TABLE 17

| | Target Resistance Member | | Organic Resinate (Trade Name) | Viscosity After Adjustment |
|---|---|---|---|---|
| Example 24 | W—Ni | W#8629 | Composed Mainly of Carboxylate | 12 cp |
| | | Ni#58-A | Composed Mainly of Carboxylate | |
| Example 25 | Zr—Cr | Zr#5437 | Composed Mainly of Carboxylate | 8 cp |
| | | Cr#52-D | Composed Mainly of Carboxylate | |
| Example 26 | Ta—Ir | Ta#7522 | Composed Mainly of Carboxylate | 10 cp |
| | | Ir#8057 | Composed Mainly of Carboxylate | |
| Example 27 | Ta—Fe | Ta#7522 | Composed Mainly of Carboxylate | 12 cp |
| | | Fe#56-C | Composed Mainly of Carboxylate | |
| Example 28 | Zr—Ni | Zr#5437 | Composed Mainly of Carboxylate | 7 cp |
| | | Ni#58-A | Composed Mainly of Carboxylate | |

| | Spinner Coating Conditions | | | | Final Film Thickness |
|---|---|---|---|---|---|
| | 1st | 2nd | Baking Conditions | | Sheet Resistance |
| Example 24 | 500 rpm | 5000 rpm | Room Temp. | 10 min. | 2300 Å |
| | 5 sec. | 30 sec. | 120° C. | 10 min. | 15 Ω/□ |
| | | | 950° C. | 10 min. | |
| Example 25 | 500 rpm | 5000 rpm | Room Temp. | 10 min. | 1300 Å |
| | 5 sec. | 30 sec. | 120° C. | 10 min. | 25 Ω/δ |
| | | | 750° C. | 10 min. | |
| Example 26 | 500 rpm | 5000 rpm | Room Temp. | 10 min. | 1800 Å |
| | 5 sec. | 30 sec. | 120° C. | 10 min. | 12 Ω/□ |
| | | | 950° C. | 10 min. | |
| Example 27 | 500 rpm | 5000 rpm | Room Temp. | 10 min. | 2300 Å |
| | 5 sec. | 30 sec. | 120° C. | 10 min. | 20 Ω/□ |
| | | | 950° C. | 10 min. | |
| Example 28 | 500 rpm | 5000 rpm | Room Temp. | 10 min. | 1000 Å |
| | 5 sec. | 30 sec. | 120° C. | 10 min. | 28 Ω/□ |
| | | | 750° C. | 10 min. | |

<Evaluation of Bubbling Characteristics>

Bubbling states of ink in response to a recording signal with a driving frequency of 10 Hz–50 kHz were visually observed for evaluation with respect to the respective recording heads made by Examples 24–28 and Comparative Examples 11–12. The result of the evaluation is shown in Table 18.

As shown in Table 18, the recording head of Comparative Example 11 has an unstable bubbling state at the driving frequency of 50 kHz. The recording head of Comparative Example 12 has an unstable bubbling state at the driving frequency of 10 kHz and a very unstable bubbling state at the driving frequency of 100 Hz or higher. On the other hand, the recording heads of Examples 24–28 have a stable ink bubbling state even at a high driving frequency because the heat generating resistance layer 103 has a small thermal capacity.

<Evaluation of Durability Against Jet Operation>

A recording signal was imposed on the respective recording heads made by Examples 24–28 and Comparative Example 11 under the conditions of driving frequency=2.0 kHz, rectangular pulse width=10 microseconds, driving voltage=bubbling voltage×1.15 and drive segment=500 bits, and durability against jet operation was evaluated by the number of broken segments thereof. The result of the evaluation is shown in Table 19.

As shown in Table 19, the recording heads of Examples 24–28 and the recording head of Comparative Example 11 have no broken segment even at $1\times10^9$ and thus they have the same durability against jet operation. More specifically, even if the heat generating resistance layer is formed by coating, the durability thereof is not inferior to that of a heat generating resistance layer made by a vacuum thin film forming process.

TABLE 18

| | Driving Frequency | | | | | | |
|---|---|---|---|---|---|---|---|
| | 10 Hz | 100 Hz | 500 Hz | 1 kHz | 5 kHz | 10 kHz | 50 kHz |
| Example 24 | ○ | ○ | ○ | ○ | ○ | ○ | ○ |
| Example 25 | ○ | ○ | ○ | ○ | ○ | ○ | ○ |
| Example 26 | ○ | ○ | ○ | ○ | ○ | ○ | ○ |
| Example 27 | ○ | ○ | ○ | ○ | ○ | ○ | ○ |
| Example 28 | ○ | ○ | ○ | ○ | ○ | ○ | ○ |
| Comparative Example 11 | ○ | ○ | ○ | ○ | ○ | ○ | ○ |
| Comparative Example 12 | Δ | x | x | x | x | x | x |

○ normal bubbling
Δ unstable bubbling
x very unstable bubbling

TABLE 19

| Number of Pulses | Number of Broken Segments $1 \times 10^8$ | $3 \times 10^8$ | $5 \times 10^8$ | $1 \times 10^9$ |
|---|---|---|---|---|
| Example 24 | 0 | 0 | 0 | 0 |
| Example 25 | 0 | 0 | 0 | 0 |
| Example 26 | 0 | 0 | 0 | 0 |
| Example 27 | 0 | 0 | 0 | 0 |
| Example 28 | 0 | 0 | 0 | 0 |
| Comparative Example 11 | 0 | 0 | 0 | 0 |

Comparative Example 13

A liquid jet recording head was made by the same way as that of Example 29 except that electrode layers 104 were not formed of an organic resinate but formed to a film thickness of 0.6 micron by vacuum evaporating Au.

Comparative Example 14

A liquid jet recording nead was made by the same way as that of Example 29 except that electrode layers 104 were not formed of an organic resinate but formed by using dispersed Au and glass formed to a thickness of about 2 microns by a printing method.

TABLE 20

| | Target Electrode | | Organic Resinate (Trade Name) | | Viscosity After Adjustment |
|---|---|---|---|---|---|
| Example 29 | Au | Au A-1118 | Composed Mainly of Carboxylate | | 15 cp |
| Example 30 | Pt | Pt#9450 | Composed Mainly of Carboxylate | | 10 cp |
| | Spinner Coating Conditions | | | | Final Film Thickness |
| | 1st | 2nd | Baking Conditions | | Sheet Resistance |
| Example 29 | 500 rpm | 3000 rpm | Room Temp. | 10 min. | 10000 Å |
| | 5 sec. | 30 sec. | 120° C. | 10 min. | 0.07 Ω/□ |
| | | | 850° C. | 10 min. | |
| Example 30 | 500 rpm | 3000 rpm | Room Temp. | 10 min. | 6000 Å |
| | 5 sec. | 30 sec. | 120° C. | 10 min. | 0.09 Ω/□ |
| | | | 850° C. | 10 min. | |

Examples 29–30

A substrate 101 was composed of silicon, and thermally oxidized $SiO_2$ was formed on the substrate 101 to a thickness of 2.0 microns as a heat accumulation layer 102. Then, $HfB_2$ was sputtered on the heat accumulation layer 102 to a film thickness of 0.1 micron as a heat generating resistance layer 103. A layer serving as electrode layers was spin coated on the heat generating resistance layer 103 by using the conditions and materials shown in Table 20. Note, metal resinates made by Engelthard Co., Ltd. (trade names are shown in Table 20) were used as an organic resinate for the material of the layers. Further, in the spin coating, the organic resinate was diluted with chloromethane to provide the material with a predetermined viscosity. The layer was formed to a circuit pattern shown in FIG. 4 to make the electrode layers 104. In addition, with the formation of the electrode layers 104, a heat generating portion 201 was also formed between the electrodes in the size of 30 microns×150 microns. A heater board was completed by the above process.

Further, a predetermined nozzle flow path, ink chamber, ink feed port, ink jet port (40 microns×40 microns) were formed on the heater board by a usual operation to complete a liquid jet recording head.

<Evaluation of Durability Against Jet Operation>

A recording signal was imposed on the respective recording heads made by Examples 29–30 and Comparative Examples 13–14 under the conditions of driving frequency=2.0 kHz, rectangular pulse width=10 microseconds, driving voltage=bubbling voltage×1.15 and drive segment=500 bits, and durability against jet operation was evaluated by the number of broken segments thereof. The result of the evaluation is shown in Table 21.

As shown in Table 21, the recording heads of Examples 29–30 and the recording head of Comparative Example 13 have no broken segment even at $1\times10^9$ and thus they have the same durability against jet operation. More specifically, even if the heat generating resistance layer is formed by coating, the durability thereof is not inferior to that of a heat generating resistance layer made by a vacuum thin film forming process. Further, it is shown that Comparative Example 14 using dispersed Au and glass has inferior durability against jet operation.

TABLE 21

| Number of Pulses | Number of Broken Segments $1 \times 10^8$ | $3 \times 10^8$ | $5 \times 10^8$ | $1 \times 10^9$ |
|---|---|---|---|---|
| Example 29 | 0 | 0 | 0 | 0 |
| Example 30 | 0 | 0 | 0 | 0 |
| Comparative Example 13 | 0 | 0 | 0 | 0 |
| Comparative Example 14 | 0 | 0 | 15 | 155 |

Example 31–35

A substrate 101 was composed of silicon, and thermally oxidized $SiO_2$ was formed on the substrate 101 to a thickness of 2.0 microns as a heat accumulation layer 102. Then, a heat generating resistance layer 103 was spin coated on the heat accumulation layer 102 by using the conditions and materials shown in Table 22. Note, metal resinates made by Engelthard Co., Ltd. (trade names are shown in Table 22) were used as an organic resinate for the material of the heat generating resistance layer 103. In the spin coating, the organic resinate was diluted with chloromethane to provide the material with a predetermined viscosity.

An electrochemically stable organic resinate material for Au, which was obtained by diluting a metal resinate made by Engelthard Co., Ltd. (trade name: A-1118, composed mainly of carboxylate) with chloromethane to a viscosity of 15 cp, was spin coated on the heat generating resistance layer 103 under the coating conditions of a first step; 500 rpm×5 seconds and a second step; 3000 rpm×30 seconds. The coated film was baked at a room temperature for 10 minutes, at 120° C. for 10 minutes and at 850° C. for 10 minutes. Then, an Au thin film having a final thickness of 1.0 micron and a sheet resistance of 0.07 ohm/□ was formed for electrode layers. Then, the Au thin film was formed to a circuit pattern shown in FIG. 4 by photolithography to form the electrode layers 104. In addition, with the formation of the electrode layers 104, a heat generating portion 201 was also formed between electrodes in the size of 30 microns× 150 microns. A heater board was completed by the above process.

Comparative Example 15

A liquid jet recording head was made by the same way as that of Example 31 except that a heat generating resistance layer 103 and electrode layers 104 were not formed of an organic resinate but the former was formed by sputtering Al—Ta—Ir to a film thickness of 0.2 micron and the latter was formed by vacuum evaporating Au to a film thickness of 0.5 micron.

Comparative Example 16

A liquid jet recording head was made by the same way as that of Example 31 except that a heat generating resistance layer 103 and electrode layers 104 were not formed of an organic resinate but the former was formed by using dispersed iridium oxide, tantalum oxide and glass formed to a thickness of about 2 microns by a printing method and the latter was formed by using dispersed Au and glass formed to a thickness of about 2 microns by a printing method.

Comparative Example 17

A liquid jet recording head was made by the same way as that of Example 31 except that a heat generating resistance layer 103 and electrode layers 104 were not formed of an organic resinate but the former was formed by sputtering Al—Ta—Ir to a film thickness of 0.2 micron and the latter was formed by using dispersed Au and glass formed to a thickness of about 2 microns by a printing method.

TABLE 22

| | Target Resistance Member | | Organic Resinate (Trade Name) | Viscosity After Adjustment |
|---|---|---|---|---|
| Example 31 | W—Ni | W#8629 | Composed Mainly of Carboxylate | 12 cp |
| | | Ni#58-A | Composed Mainly of Carboxylate | |
| Example 32 | Zr—Cr | Zr#5437 | Composed Mainly of Carboxylate | 8 cp |
| | | Cr#52-D | Composed Mainly of Carboxylate | |
| Example 33 | Ta—Ir | Ta#7522 | Composed Mainly of Carboxylate | 10 cp |
| | | Ir#8057 | Composed Mainly of Carboxylate | |
| Example 34 | Ta—Fe | Ta#7522 | Composed Mainly of Carboxylate | 12 cp |
| | | Fe#56-C | Composed Mainly of Carboxylate | |
| Example 35 | Zr—Ni | Zr#5437 | Composed Mainly of Carboxylate | 7 cp |
| | | Ni#58-A | Composed Mainly of Carboxylate | |

| | Spinner Coating Conditions | | | | Final Film Thickness |
|---|---|---|---|---|---|
| | 1st | 2nd | Baking Conditions | | Sheet Resistance |
| Example 31 | 500 rpm | 5000 rpm | Room Temp. | 10 min. | 2300 Å |
| | 5 sec. | 30 sec. | 120° C. | 10 min. | 15 Ω/□ |
| | | | 950° C. | 10 min. | |
| Example 32 | 500 rpm | 5000 rpm | Room Temp. | 10 min. | 1300 Å |
| | 5 sec. | 30 sec. | 120° C. | 10 min. | 25 Ω/□ |
| | | | 750° C. | 10 min. | |
| Example 33 | 500 rpm | 5000 rpm | Room Temp. | 10 min. | 1800 Å |
| | 5 sec. | 30 sec. | 120° C. | 10 min. | 12 Ω/□ |
| | | | 950° C. | 10 min. | |
| Example 34 | 500 rpm | 5000 rpm | Room Temp. | 10 min. | 2300 Å |
| | 5 sec. | 30 sec. | 120° C. | 10 min. | 20 Ω/□ |
| | | | 950° C. | 10 min. | |
| Example 35 | 500 rpm | 5000 rpm | Room Temp. | 10 min. | 1000 Å |
| | 5 sec. | 30 sec. | 120° C. | 10 min. | 28 Ω/□ |
| | | | 750° C. | 10 min. | |

Further, a predetermined nozzle flow path, ink chamber, ink feed port, ink jet port (40 microns×40 microns) were formed on the heater board by a usual operation to complete a liquid jet recording head.

<Evaluation of Bubbling Characteristics>

Bubbling states of ink in response to a recording signal with a driving frequency of 10 Hz–50 kHz were visually observed for evaluation with respect to the respective recording heads made by Examples 31–35 and Comparative Examples 15–17. The result of the evaluation is shown in Table 23.

As shown in Table 23, the recording head of Comparative Example 16 has an unstable bubbling state at the driving frequency of 10 kH and a very unstable bubbling state at the driving frequency of 100 Hz or higher. On the other hand, the recording heads of Examples 31–35 have a stable ink bubbling state even at a high driving frequency because the heat generating resistance layer 103 has a small heat capacity, the second protection layer has a large heat transfer coefficient and a thin film thickness, and thus the first protection layer 105 may be thin.

TABLE 23

| | Driving Frequency | | | | | | |
|---|---|---|---|---|---|---|---|
| | 10 Hz | 100 Hz | 500 Hz | 1 kHz | 5 kHz | 10 kHz | 50 kHz |
| Example 31 | ○ | ○ | ○ | ○ | ○ | ○ | ○ |
| Example 32 | ○ | ○ | ○ | ○ | ○ | ○ | ○ |
| Example 33 | ○ | ○ | ○ | ○ | ○ | ○ | ○ |
| Example 34 | ○ | ○ | ○ | ○ | ○ | ○ | ○ |
| Example 35 | ○ | ○ | ○ | ○ | ○ | ○ | ○ |
| Comparative Example 15 | ○ | ○ | ○ | ○ | ○ | ○ | ○ |
| Comparative Example 16 | Δ | x | x | x | x | x | x |
| Comparative Example 17 | ○ | ○ | ○ | ○ | ○ | ○ | ○ |

○ normal bubbling
Δ unstable bubbling
x very unstable bubbling

<Evaluation of Durability Against Jet Operation>

A recording signal was imposed on the respective recording heads made by Examples 31–35 and Comparative Examples 15–17 under the conditions of driving frequency=2.0 kHz, rectangular pulse width=10 microseconds, driving voltage=bubbling voltage×1.15 and drive segment=500 bits, and durability against jet operation was evaluated by the number of broken segments thereof. The result of the evaluation is shown in Table 24.

As shown in Table 24, the recording heads of Examples 31–35 and the recording head of Comparative Example 15 have no broken segment even at $1\times10^9$ and thus they have the same durability against jet operation. More specifically, even if the heat generating resistance layer is formed by coating, the durability thereof is not inferior to that of a heat generating resistance layer made by a vacuum thin film forming process. Further, it is shown that Comparative Example 16 using dispersed Au and glass has inferior durability against jet operation.

TABLE 24

| | Number of Broken Segments | | | |
|---|---|---|---|---|
| Number of Pulses | $1 \times 10^8$ | $3 \times 10^8$ | $5 \times 10^8$ | $1 \times 10^9$ |
| Example 31 | 0 | 0 | 0 | 0 |
| Example 32 | 0 | 0 | 0 | 0 |
| Example 33 | 0 | 0 | 0 | 0 |
| Example 34 | 0 | 0 | 0 | 0 |
| Example 35 | 0 | 0 | 0 | 0 |
| Comparative Example 15 | 0 | 0 | 0 | 0 |

TABLE 24-continued

| | Number of Broken Segments | | | |
|---|---|---|---|---|
| Number of Pulses | $1 \times 10^8$ | $3 \times 10^8$ | $5 \times 10^8$ | $1 \times 10^9$ |
| Comparative Example 16 | 0 | 0 | 15 | 155 |

The present invention achieves an excellent advantage particularly in the ink jet recording type recording head and recording apparatus which make recording by forming flying droplets by making use of thermal energy among various ink jet recording systems.

A typical arrangement and principle of the ink jet recording system are disclosed, for example, in the specifications of U.S. Pat. Nos. 4,723,129 and 4,740,796, and the present invention is preferably executed by using the basic principle of these patents. This recording system is applicable to any of so-called on-demand type and continuous type recording systems.

To briefly describe this recording system, thermal energy is generated by imposing at least one drive signal on an electrothermal converter disposed in correspondence to a sheet or liquid path in which liquid (ink) is held in order to abruptly increase the temperature of the liquid (ink) so that a film boiling phenomenon exceeding a nuclear boiling phenomenon is arisen in the ink (liquid) in correspondence to recorded data and thus the film boiling is caused on the heat acting surface of a recording head. Since bubbles can be formed in such a manner that each bubble corresponds to each drive signal imposed on the electrothermal converter from the liquid (ink) as described above, this recording system is particularly effective to an on-demand type recording method. The liquid (ink) is jetted from a jet port by the growth/contraction of the bubbles to form at least single droplet. When the drive signal is made to a pulse shape, the growth/contraction of the bubbles are instantaneously and properly effected, and thus liquid (ink) particularly excellent in responsiveness can be jetted, which is more preferable. A suitable pulse-shaped driven signal is disclosed in the specifications of U.S. Pat. Nos. 4,463,395 and 4,345,262. Note, when the conditions described in U.S. Pat. No. 4,313,124 regarding a temperature rising ratio of the above heat acting surface are employed, more excellent recording can be performed.

With respect to an arrangement of the recording head, the present invention also includes the arrangement of a recording head having a heat acting portion disposed in a bent region as shown in the specifications of U.S. Pat. Nos. 4,558,333 and 4,459,600, in addition to the arrangement in which an ink jet port, liquid flow path and electrothermal converter are combined (linear or right angle liquid path) as disclosed in the above respective specifications.

In addition, the present invention is effectively applied to the arrangement disclosed in Japanese Patent Application Laid-Open No. 59-123670 in which a common slit is provided as a jet port for a plurality of electrothermal converters and the arrangement disclosed in Japanese Patent Application Laid-Open No. 59-138461 in which an opening for absorbing the pressure wave of thermal energy is provided in correspondence to a jet port.

Further, the present invention is effectively applied to a full line type recording head having a length corresponding to the maximum width of a recording medium to which a recording apparatus can make recording. This full line head may be arranged to a full line by combining a plurality of the recording heads disclosed in the above specifications or an integrally formed single full line recording head.

In addition, the present invention is also effectively applied to the cases in which a replaceable tip type recording head is used which, when mounted on the main body of an apparatus, is electrically connected to the main body or supplied with ink therefrom or in which a cartridge type recording head integrally provided with a recording head itself is used.

Further, the recording apparatus of the present invention is preferably added with a recovery means for a recording head, preliminary auxiliary means and the like to further stabilize the recording apparatus of the present invention. More specifically, the recording head may be added with a capping means, cleaning means, pressurizing or sucking means, electrothermal converter, heating element other than the electrothermal converter, preliminary heating means composed of the combination thereof, and means for effecting a preliminary jetting mode for performing jetting other than recording in order to stably execute recording.

Further, the present invention is very effectively applied not only to a recording apparatus having a recording mode only for a main color such as a black color or full colors composed of mixed colors, although a recording head may be arranged integrally or by the combination of a plurality of recording heads.

Although the examples of the present invention described above are mentioned as using liquid ink, the present invention may use any ink material solidified or softened at a room temperature. Since the aforesaid ink jet apparatus generally adjusts the temperature of an ink material itself within the range from 30° C. to 70° C. so that the ink material has a viscosity within a stable jet range, any ink material may be employed so long as it is in a liquid state when a recording signal being used is applied.

In addition, there may be used such an ink material that can positively prevent an excessive temperature rise of a head and the ink material caused by thermal energy by using the energy to change the state of the ink material from a solid state to a liquid state or an ink material that solidifies when left unused in order to prevent the evaporation thereof. In any case, also applied to the present invention is any ink material which has a property to be liquefied first by the application of thermal energy, such as the one which is liquefied and jetted as liquid ink by the application of thermal energy corresponding to a recording signal or the one which has been started to be solidified when it reaches a recording medium.

These ink materials may confront an electrothermal converter in the state that they are held in the recessed portions or through holes of a porous sheet as a liquid or solid material, as disclosed in Japanese Patent Applications Laid-Open Nos. 54-56847 and 60-71260.

In the present invention, the execution of the aforesaid film boiling system is most effective to the aforesaid respective ink materials.

What is claimed is:

1. A method for manufacturing a liquid jet recording apparatus having a discharge port for discharging a liquid, a liquid path for retaining the liquid and communicated with the discharge port and an electrothermal converting element provided in the liquid path to apply thermal energy to the liquid, the electrothermal converting element having a heat generating resistive layer for generating thermal energy upon application of voltage and an electrode layer electrically connected to the heat generating resistive layer, the apparatus discharging the liquid by utilizing the thermal energy generated by the electrothermal converting element, said method comprising the steps of:

applying, by means of spin coating, a coating to a substrate which extends along said path, said coating comprising, in combination, a plurality of organic resinates and a metallic component which becomes the heat generating resistive layer; and forming the heat generating resistive layer by drying and calcining the coating to remove organic components from the organic resinate to obtain a layer having high durability.

2. A method for manufacturing a liquid jet recording apparatus having a discharge port for discharging a liquid, a liquid path for retaining the liquid and communicated with the discharge port and an electrothermal converting element provided in the liquid path to apply thermal energy to the liquid and a cavitation-resistant layer provided on the electrothermal converting element to protect the electrothermal converting element from the liquid and to transfer thermal energy from said electrothermal converting element to liquid in said path, the electrothermal converting element having a heat generating resistive layer for generating thermal energy upon application of voltage and an electrode layer electrically connected to the heat generating resistive layer, the apparatus discharging the liquid by utilizing the thermal energy generated by the electrothermal converting element, said method comprising the steps of:

applying, by means of spin coating, a coating to a substrate which extends along said path, said coating comprising principally an organic resinate and a metallic component which is selected from the group consisting of at least one of Ta, Pt, Ti, Mo and W and which becomes the cavitation-resistant layer; and forming the cavitation-resistant layer by drying and calcining the coating to remove the organic components from the organic resinate so that the cavitation resistant material comprises a metal from said group.

3. A method of manufacturing a liquid jet recording apparatus according to claim 2, further comprising a step of forming the heat generating resistive layer and the electrode layer by drying and baking a paste composed mainly of an organic resinate.

4. A method for manufacturing a liquid jet recording apparatus according to claim 1, further comprising a step of forming the heat generating resistive layer and the electrode layer by drying and baking a paste composed mainly of an organic resinate.

* * * * *

UNITED STATES PATENT AND TRADEMARK OFFICE

CERTIFICATE OF CORRECTION

PATENT NO. : 6,406,740 B1
DATED : June 18, 2002
INVENTOR(S) : Hirokazu Komuro

It is certified that error appears in the above-identified patent and that said Letters Patent is hereby corrected as shown below:

Title page,
Item [56], FOREIGN PATENT DOCUMENTS, “8/1994” should read -- 8/1984 --.

Column 1,
Line 36, “acted” should read -- applied --; and
Line 66, “making” should read -- reducing --.

Column 2,
Line 8, “as well as” should read -- and --;
Line 22, “use” should read -- used --;
Line 40, “arkoxide,” should read -- alkoxide, --; and
Line 41, “bolic” should read -- boric --.

Column 3,
Lines 5 and 12, “cross sectional” should read -- cross-sectional --; and
Lines 10 and 16, “cross sectional” (both occurrences) should read -- cross-sectional --.

Column 5,
Line 27, “silicon” should read -- silicone --; and
Lines 45, 47 and 48, “cross sectional” should read -- cross-sectional --.

Column 6,
Line 10, “an organic resinate” should read -- organic resinates --.

Column 9,
Line 19, “were” should read -- was --; and
Line 23, “an organic resinate” should read -- organic resinates --.

Column 11,
Line 51, “an organic resinate” should read -- organic resinates --; and
Line 61, “step; 500 rpm×5 seconds and a second step;” should read -- step, 500 rpm×5 seconds, and a second step, --.

Column 15,
Line 65, “an organic resinate” should read -- organic resinates --.

Column 16,
Table 10, “M○” should read -- MoH --; and “w” should read -- W --.

UNITED STATES PATENT AND TRADEMARK OFFICE

CERTIFICATE OF CORRECTION

PATENT NO. : 6,406,740 B1
DATED : June 18, 2002
INVENTOR(S) : Hirokazu Komuro

It is certified that error appears in the above-identified patent and that said Letters Patent is hereby corrected as shown below:

Column 17,
Line 64, “an organic resinate” should read -- organic resinates --.

Column 18,
Line 6, “step; 500 rpm×5 seconds and a second step;” should read -- step, 500 rpm×5 seconds, and a second step, --;
Line 41, “an” should be deleted; and
Line 42, “resinate” should read -- resinates --.

Column 21,
Lines 52, 54 and 55, “cross sectional” should read -- cross-sectional --.

Column 22,
Line 25, “an organic resinate” should read -- organic resinates --.

Column 27,
Line 10, “an organic resinate” should read -- organic resinates --;
Line 19, “step;” should read -- step, --; and
Line 20, “seconds and a second step;” should read -- seconds, and a second step, --.

Column 30,
Line 57, “single” should read -- one single --.

Signed and Sealed this

Tenth Day of December, 2002

JAMES E. ROGAN
*Director of the United States Patent and Trademark Office*